US008800889B2

(12) United States Patent
Wang

(10) Patent No.: US 8,800,889 B2
(45) Date of Patent: Aug. 12, 2014

(54) IMPACT SPRINKLER WITH ADJUSTABLE COUNTERWEIGHT MEMBER

(76) Inventor: Cheng-An Wang, Chang Hua Hsien (TW)

( * ) Notice: Subject to any disclaimer, the term of this patent is extended or adjusted under 35 U.S.C. 154(b) by 262 days.

(21) Appl. No.: 13/554,116

(22) Filed: Jul. 20, 2012

(65) Prior Publication Data

US 2014/0021271 A1 Jan. 23, 2014

(51) Int. Cl.

| | |
|---|---|
| ***B05B 3/02*** | (2006.01) |
| ***B05B 3/14*** | (2006.01) |
| ***B05B 3/04*** | (2006.01) |

(52) U.S. Cl.

CPC ..... *B05B 3/0472* (2013.01); *B05B 3/0481* (2013.01)

USPC ..... 239/230

(58) Field of Classification Search

CPC ..... B05B 3/0472; B05B 3/0481; B05B 3/165

USPC ..... 239/225.1, 227, 230, 233, DIG. 1; 16/400

See application file for complete search history.

(56) References Cited

U.S. PATENT DOCUMENTS

| | | | | | |
|---|---|---|---|---|---|
| 2,545,745 | A * | 3/1951 | Newton | 239/227 |
| 2,745,699 | A * | 5/1956 | Orr | 239/231 |
| 2,769,666 | A * | 11/1956 | Spender | 239/230 |
| 2,877,053 | A * | 3/1959 | Kennard | 239/233 |
| 4,151,956 | A * | 5/1979 | Elliott | 239/230 |
| 2012/0241538 | A1 * | 9/2012 | Wang | 239/230 |

* cited by examiner

*Primary Examiner* — Darren W Gorman

(74) *Attorney, Agent, or Firm* — Egbert Law Offices, PLLC

(57) ABSTRACT

An impact sprinkler with an adjustable counterweight member has a main body, a rotation guiding member, a driving section, and an adjustable counterweight member. The counterweight member is provided on the driving section in a state for segmentation positioning, including a counterweight component and an adjusting structure. The counterweight component can be assembled with or disassembled from the adjusting structure, and the adjusting structure is made up of multiple spaced positioning edges configured on the corresponding positions of the driving section and counterweight component and at least one elastic clamping fringe, and the elastic clamping fringe can be clasped on any positioning edge to fix the counterweight component. This enables flexible adjustment and segmentation positioning of the counterweight component, so as to accurately control the swing angle of the swinging part, and avoid displacement of the counterweight component caused by vibration or collision.

5 Claims, 4 Drawing Sheets

IMPACT SPRINKLER WITH ADJUSTABLE COUNTERWEIGHT MEMBER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an impact sprinkler, and more particularly to an innovative impact sprinkler with an adjustable counterweight member to accurately control the swing angle of the swinging part.

2. Description of Related Art Including Information Disclosed Under 37 CFR 1.97 and 37 CFR 1.98.

Impact sprinklers are commonly used nowadays for gardening and agriculture. A typical impact sprinkler is installed with a rotation guiding member, which will be driven by the water flow so that the impact sprinkler will conduct cyclical watering within a circular area. In order to control and maintain sufficient irrigation, the operator will usually install a counterweight block on one end of the rotation guiding member. Through the weight of the counterweight block, the swing angle of the rotation guiding member can be adjusted.

However, the counterweight block is fixed on a preset part of the rotation guiding member and is not adjustable. In order to change the swing angle of the rotation guiding member, the typical method is to replace with an impact sprinkler with a different counterweight block. Different counterweight blocks are used for different swing angles needed by the user. Therefore, there is a necessity to produce multiple types of impact sprinklers. Such a practice not only requires considerable production cost, but also causes inconvenience and time consumption in the replacement.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention of an impact sprinkler with an adjustable counterweight member has the following main characteristics: the adjusting structure of the adjustable counterweight member is in a state of segmentation positioning, the adjusting structure is made up of multiple spaced positioning edges configured on the corresponding positions of the driving section and counterweight component and at least one elastic clamping fringe, and the elastic clamping fringe can be clasped on any positioning edge to fix the counterweight component. Based on such an innovative and unique design, comparer to prior art, the present invention enables flexible adjustment and segmentation positioning of the counterweight component, so as to accurately control the swing angle of the swinging part, and avoid displacement of the counterweight component caused by vibration or collision, and meanwhile avoid the problem of excessive or insufficient irrigation due to change of the swing angle of the swinging part. Moreover, the swing angle of the swinging part can be stably and accurately controlled without a need to manufacture multiple types of impact sprinkler with different counterweight. Thus, such practical benefits of convenience, product practicability and reduced production cost are greatly enhanced.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
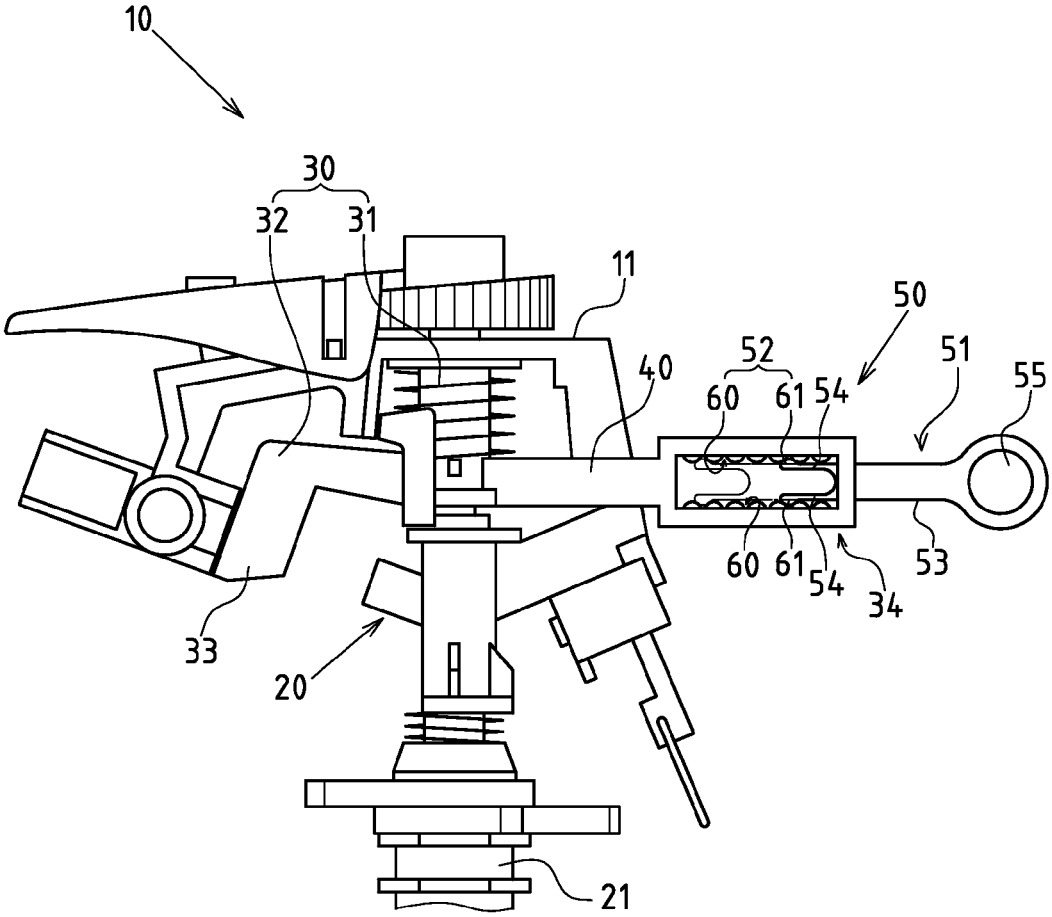
FIG. 1 is a plan view of the overall shape of the present invention.
Figure 2:
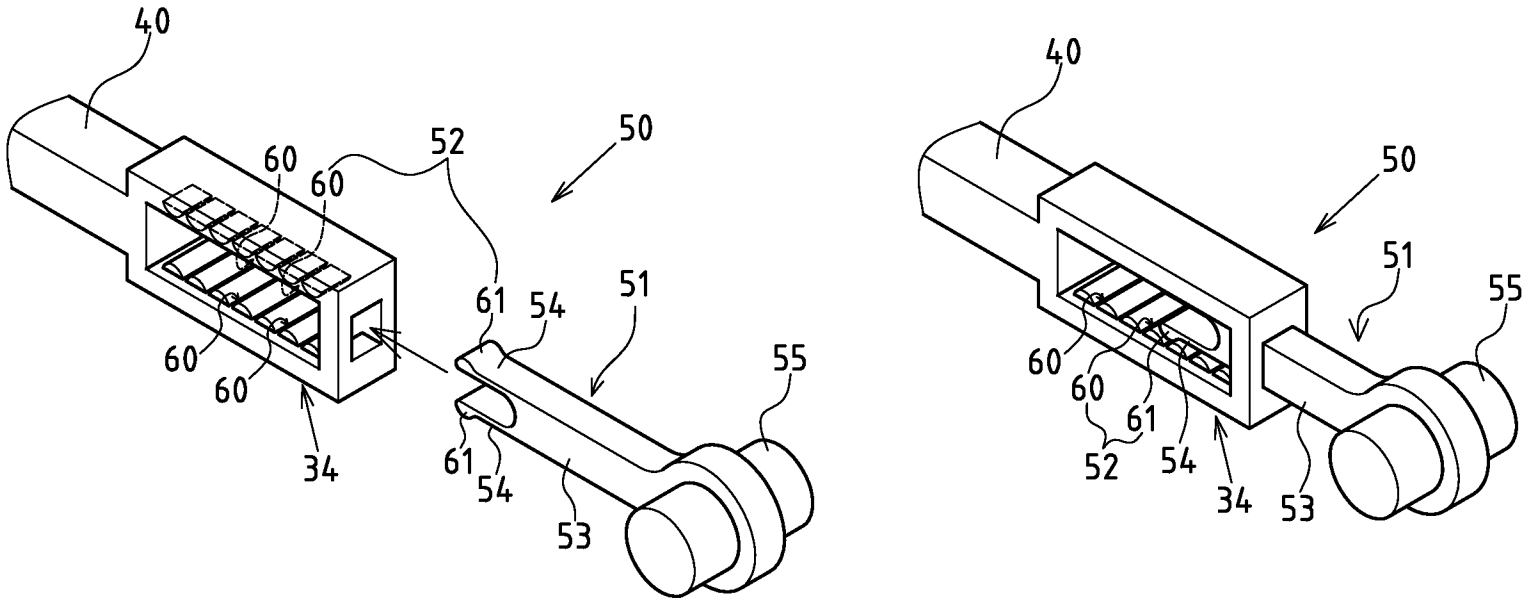
FIG. 2 is a schematic illustration of the assembled state of the present invention counterweight component and adjusting structure.

FIGS. 1 and 2 depict a preferred embodiment of the present invention of an impact sprinkler with an adjustable counterweight member. However, such an embodiment is illustrative only and is not intending to restrict the scope of patent application.

Said impact sprinkler 10 comprises a main body 20, with the lower end of the main body 20 provided with an inlet water pipe joint end 21, and the upper end of the main body 20 provided with a top section part 11.

A rotation guiding member 30 is provided on the top section part 11 configured on the top end of the main body 20, including a torsional spring 31 and a swinging part 32, wherein the swinging part 32 defines a front section 33 and a rear section 34, while the front section 33 or rear section 34 of the swinging part 32 forms a driving section 40 (in this embodiment, the driving section 40 is formed by the rear section 34 of the swinging part 32).

An adjustable counterweight member 50 is provided on the driving section 40 in a form of segmentation positioning, made up of a counterweight component 51, an adjusting structure 52, wherein the counterweight component 51 can be assembled with or disassembled from the adjusting structure 52, while the adjusting structure 52 is made up of a plurality of spaced positioning edges 60 provided on the driving section 40 and counterweight component 51 and at least one elastic clamping fringe 61. The elastic clamping fringe 61 can be clasped on any positioning edge 60 to fix the counterweight component 51.

In this way, the counterweight component 51 can have a state for flexible adjustment and segmentation positioning, so as to accurately control the swing angle of the swinging part 32, and to effectively avoid movement of the counterweight component 51 caused by vibration or collision.

Figure 3:
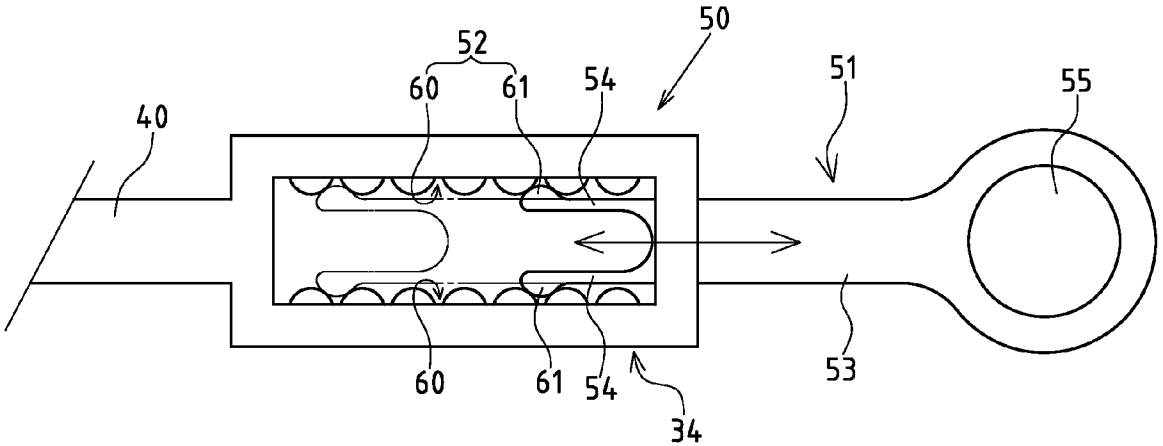
FIG. 3 is a schematic view showing the first embodiment of the present invention counterweight component and adjusting structure.

FIG. 3 depicts the first embodiment of the present invention of the adjustable counterweight member 50. One end of the driving section 40 is in the shape of a frame, while the positioning edge 60 of the adjusting structure 52 is formed inside the driving section 40. The counterweight component 51 comprises a frame part 53, elastic plates 54 integrally formed on one end of the frame part 53 spaced and opposite to each other, and a weight block 55 provided on the end of the frame part 53 opposite to the end with the elastic plates 54. The elastic clamping fringe 61 of the adjusting structure 52 is configured on the tip of the elastic plates 54. By inserting the counterweight component 51 into the driving section 40, the elastic plates 54 will firstly be shrank and moved, and then the elastic clamping fringe 61 will be clasped with the positioning edge 60. In this way, the counterweight component 51 can have a state for flexible adjustment and segmentation positioning, and combining with the weight block 55, it can accurately adjust the swing angle of the swinging part 32, and increase the stability during adjustment of the counterweight component 51 to avoid displacement caused by collision or vibration. Moreover, the counterweight component 51 can be integrally made of heavy materials (such as metal) to achieve the function of accurate adjustment of the swing angle of the swinging part in a similar way based on the weight of the counterweight component 51 itself.

Figure 4:
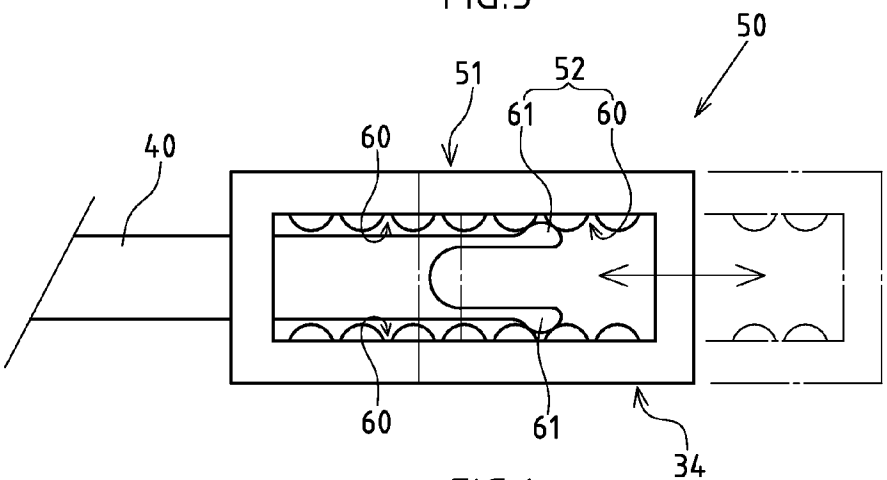
FIG. 4 is a schematic view showing the second embodiment of the present invention counterweight component and adjusting structure.

FIG. 4 depicts a second embodiment of the present invention of an adjustable counterweight member 50, wherein the positioning edges 60 of the adjusting structure 52 are configured on the inside of the counterweight component 51 (here, the counterweight component 51 is preferably, but not limited to a weighted frame), while the elastic clamping fringes 61 of the adjusting structure 52 is formed on the driving section 40, so that the counterweight component 51 can have a state for flexible adjustment and segmentation positioning based on the clasping between the positioning edges 60 and elastic clamping fringes 61.

Figure 5:
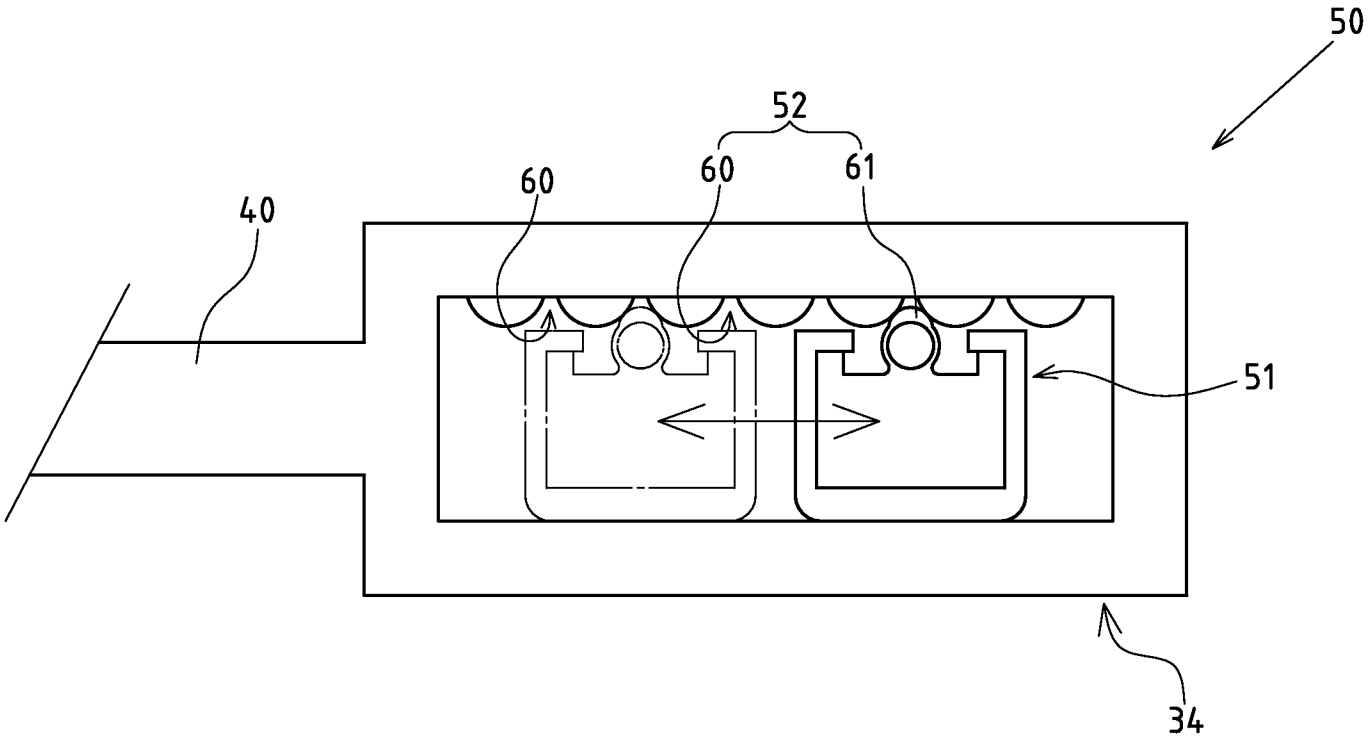
FIG. 5 is a schematic view showing the third embodiment of the present invention counterweight component and adjusting structure.

FIG. 5 depicts a third embodiment of the present invention of an adjustable counterweight member 50, wherein one end of the driving section 40 is in the shape of a frame, and the positioning edges 60 of the adjusting structure 52 are formed inside the driving section 40, and wherein, the counterweight component 51 is in the shape of a block (weighted) and is provided inside the driving section 40, while the elastic clamping fringes 61 of the adjusting structure 52 are configured on one end of the counterweight component 51. Through clasping between the elastic clamping fringes 61 and the positioning edges 60, the user can directly turn the counterweight component 51, so that the counterweight component 51 can move inside the driving section 40 in a state for segmentation positioning. This will enhance convenience in adjustment and minimize the chance of damage of the counterweight component 51 to increase its lifecycle.

I claim:

1. An impact sprinkler, comprising:

a main body, with a lower end of the main body being provided with an inlet water pipe joint end, and an upper end of the main body being provided with a top section part;

a rotation guiding member provided on the top section part of the upper end of the main body, including a torsional spring and a swinging part, wherein the swinging part defines a front section and a rear section, and wherein the rear section of the swinging part forms a driving section;

an adjustable counterweight member provided on the driving section and being capable of segmentation positioning, the adjustable counterweight member being made up of a counterweight component and an adjusting structure, wherein the adjusting structure includes a plurality of spaced positioning edges and at least one elastic clamping fringe, and wherein each of the at least one elastic clamping fringe is adapted for selectively clasping on any one of the positioning edges so as to fix the counterweight component in a selected position on the adjusting structure, whereby the counterweight component has a state for flexible adjustment and segmentation positioning, so as to accurately control a swing angle of the swinging part, and to effectively avoid movement of the counterweight component caused by vibration or collision.

2. The impact sprinkler defined in claim 1, wherein one end of the driving section is in the shape of a frame, and the positioning edges of the adjusting structure are formed inside the driving section; and wherein the at least one elastic clamping fringe of the adjusting structure is configured on an end of the counterweight component; whereby when inserting the counterweight component into the driving section, the at least one elastic clamping fringe will be clasped with at least one of the positioning edges.

3. The impact sprinkler defined in claim 2, wherein the counterweight component comprises a frame part, and a pair of opposing elastic plates are integrally formed on one end of the frame part; and wherein a weight block is provided on an end of the frame part opposite to the end with the elastic plates; and wherein one each of the at least one elastic clamping fringe of the adjusting structure is configured on a tip of each of the elastic plates.

4. The impact sprinkler defined in claim 1, wherein one end of the driving section is in the form of a frame, and the positioning edges of the adjusting structure are formed inside the driving section; and wherein the counterweight component is in the shape of a block and is provided inside the driving section, and the at least one elastic clamping fringe of the adjusting structure is configured on one end of the counterweight component; whereby directly turning the counterweight component, the counterweight component can move inside the driving section in a state for segmentation positioning.

5. The impact sprinkler defined in claim 1, wherein the counterweight component is in the form of a frame, and the positioning edges of the adjusting structure are configured inside of the counterweight component; and wherein the at least one elastic clamping fringe of the adjusting structure is formed on the driving section; whereby the counterweight component has a state for flexible adjustment and segmentation positioning based on the clasping between the positioning edges and the at least one elastic clamping fringe.

* * * * *